US006558779B1

(12) United States Patent
Vanmaele et al.

(10) Patent No.: US 6,558,779 B1
(45) Date of Patent: May 6, 2003

(54) INK JET RECORDING ELEMENT

(75) Inventors: Luc Vanmaele, Lochristi (BE); Stefaan Lingier, Assenede (BE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 10/179,931

(22) Filed: Jun. 24, 2002

Related U.S. Application Data

(60) Provisional application No. 60/308,287, filed on Jul. 27, 2001.

(30) Foreign Application Priority Data

Jul. 3, 2001 (EP) ..... 01000266

(51) Int. Cl.[7] ..... B41J 2/05
(52) U.S. Cl. ..... 428/195; 428/206
(58) Field of Search ..... 428/195, 206, 428/325, 500

(56) References Cited

U.S. PATENT DOCUMENTS 4,770,943 A * 9/1988 Hakamatsuka et al. ..... 428/471
4,871,578 A * 10/1989 Adam et al. ..... 427/2
4,897,250 A * 1/1990 Sumita ..... 423/308
5,047,031 A * 9/1991 Constantz ..... 606/77
5,322,675 A * 6/1994 Hakamatsuka et al. ..... 423/311
5,496,399 A * 3/1996 Ison et al. ..... 106/35
5,500,668 A * 3/1996 Malhotra et al. ..... 347/105
5,525,148 A * 6/1996 Chow et al. ..... 106/35
5,854,307 A * 12/1998 Kimura et al. ..... 523/161
5,939,039 A * 8/1999 Sapieszko et al. ..... 423/311
5,985,425 A * 11/1999 Tomizawa et al. ..... 428/212
6,013,354 A * 1/2000 Tomizawa et al. ..... 428/206
6,117,456 A * 9/2000 Lee et al. ..... 424/602
6,143,408 A * 11/2000 Fujita ..... 428/355 R
6,329,113 B1 * 12/2001 Bourdelais et al. ..... 430/60
6,331,312 B1 * 12/2001 Lee et al. ..... 424/426
6,426,114 B1 * 7/2002 Troczynski et al. ..... 427/2.27
6,432,517 B1 * 8/2002 Yokota et al. ..... 428/195

OTHER PUBLICATIONS

European Search Report, Application No. 01 00 0266, Nov. 26, 2001.

* cited by examiner

*Primary Examiner*—Cynthia H. Kelly
*Assistant Examiner*—B. Shewareged
(74) *Attorney, Agent, or Firm*—Joseph T. Guy; Nexsen Pruet Jacobs & Pollard, LLC

(57) ABSTRACT

An ink jet recording element is disclosed comprising a support and an ink receiver layer comprising a binder and a calcium phosphate pigment showing the whitlockite crystal structure. Improved ink absorptivity and drying time are obtained.

6 Claims, No Drawings

INK JET RECORDING ELEMENT

This application claims the priority of Provision application No. 60/308,287 filed Jul. 27, 2001.

DESCRIPTION

1. Field of the Invention

The present invention relates to an improved recording element for ink jet printing.

2. Background of the Invention

In the majority of applications printing proceeds by pressure contact of an ink-loaden printing form with an ink-receiving material which is usually plain paper. The most frequently used impact printing technique is known as lithographic printing based on the selective acceptance of oleophilic ink on a suitable receptor.

In recent times however so-called non-impact printing systems have replaced classical pressure-contact printing to some extent for specific applications. A survey is given e.g. in the book "Principles of Non Impact Printing" by Jerome L. Johnson (1986), Palatino Press, Irvine, Calif. 92715, USA.

Among non-impact printing techniques ink jet printing has become a popular technique because of its simplicity, convenience and low cost. Especially in those instances where a limited edition of the printed matter is needed ink jet printing has become a technology of choice. A recent survey on progress and trends in ink jet printing technology is given by Hue P. Le in *Journal of Imaging Science and Technology* Vol. 42 (1), Jan./Feb. 1998.

In ink jet printing tiny drops of ink fluid are projected directly onto an ink receptor surface without physical contact between the printing device and the receptor. The printing device stores the printing data electronically and controls a mechanism for ejecting the drops image-wise. Printing is accomplished by moving the print head across the paper or vice versa. Early patents on ink jet printers include U.S. Pat. No. 3,739,393, U.S. Pat. No. 3,805,273 and U.S. Pat. No. 3,891,121.

The jetting of the ink droplets can be performed in several different ways. In a first type of process a continuous droplet stream is created by applying a pressure wave pattern. This process is known as continuous ink jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink jet printing several jets are deflected to a different degree and thus record the image (multideflection system).

According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method"), or by means of discrete thermal pushes (so-called "bubble jet" method, or "thermal jet" method).

Ink compositions for ink jet typically include following ingredients: dyes or pigments, water and/or organic solvents, humectants such as glycols, detergents, thickeners, polymeric binders, preservatives, etc. It will be readily understood that the optimal composition of such an ink is dependent on the ink jetting method used and on the nature of the substrate to be printed. The ink compositions can be roughly divided in:

- water based; the drying mechanism involves absorption, penetration and evaporation;
- oil based; the drying involves absorption and penetration;
- solvent based; the drying mechanism involves primarely evaporation;
- hot melt or phase change: the ink vehicle is liquid at the ejection temperature but solid at room temperature; drying is replaced by solidification;
- UV-curable; drying is replaced by polymerization.

It is known that the ink-receiving layers in ink-jet recording elements must meet different stringent requirements:

- The ink-receiving layer should have a high ink absorbing capacity, so that the dots will not flow out and will not be expanded more than is necessary to obtain a high optical density.
- The ink-receiving layer should have a high ink absorbing speed (short ink drying time) so that the ink droplets will not feather if smeared immediately after applying.
- The ink dots that are applied to the ink-receiving layer should be substantially round in shape and smooth at their peripheries. The dot diameter must be constant and accurately controlled.
- The receiving layer must be readily wetted so that there is no "puddling", i.e. coalescence of adjacent ink dots, and an earlier absorbed ink drop should not show any "bleeding", i.e. overlap with neighbouring or later placed dots.
- Transparent ink-jet recording elements must have a low haze-value and be excellent in transmittance properties.
- After being printed the image must have a good resistance regarding water-fastness, light-fastness, and good endurance under severe conditions of temperature and humidity.
- The ink jet recording element may not show any curl or sticky behaviour if stacked before or after being printed.
- The ink jet recording element must be able to move smoothly through different types of printers.

All these properties are often in a relation of trade-off. It is difficult to satisfy them all at the same time.

It is known that the presence in the ink accepting layer of absorptive pigments such as silica, kaolin, talc, aluminum oxide, boehmite, etc. improves the absorption capacity, the obtainable colour density and the drying time. Many patent applications have described this effect for many different binder-systems. U.S. Pat. No. 3,357,846 describes pigments such as kaolin, talc, bariet, $TiO_2$ used in starch and PVA. U.S. Pat. No. 3,889,270 describes silica in gelatin, PVA and cellulose. Pigments and particles have also been described in patent applications including DE 2,925,769, GB 2,050,866, U.S. Pat. No. 4,474,850, U.S. Pat. No. 4,547,405, U.S. Pat. No. 4,578,285, WO 88 06532, U.S. Pat. No. 4,849,286, EP 339604, EP 400681, EP 407881, EP 411638 and U.S. Pat. No. 5,045,864 (non-exhaustive list).

These particulates are dispersed in various types of binders of which the most common types are gelatin, polyvinyl alcohol, polyvinyl pyrrolidone, and various types of cellulose derivatives. These conventional binders are mentioned in numerous patent documents.

Since printing speeds are becoming ever faster the issue of fast ink droplet absorption is a crucial one. A first droplet must be absorbed into the interior of the receiver layer before a second one arrives at the same pixel. So, to improve this property there is a permanent need for better absorptive pigments.

The present invention extends the teachings on ink-absorptive pigments in ink jet recording media.

OBJECTS OF THE INVENTION

It is an object of the present invention to provide an ink jet recording element with high ink absorptivity.

It is a further object of the present invention to provide an ink jet recording element with very fast drying characteristics.

SUMMARY OF THE INVENTION

The above mentioned objects are realised by providing an ink jet recording element comprising a support and an ink receiving layer containing a binder and $Ca_3(PO_4)_2$ pigment characterized in that said $Ca_3(PO_4)_2$ pigment consists substantially of the whitlockite crystal structure.

DETAILED DESCRIPTION OF THE INVENTION

The essence of the present invention is the fact that the pigment incorporated in the ink receiver layer is calcium phosphate ($Ca_3(PO_4)_2$) substantially completely composed of the so-called whitlockite crystal structure, also called β-calcium triphosphate (β-CTP), which is a rhombohedral crystal structure. By "substantially" is meant that the great majority of the calcium phosphate present shows this crystal structure. Minor amounts of other crystal structures which also can deviate stoechiometrically from $Ca_3(PO_4)_2$ may be present, such as apatite, hydroxylapatite, monetite, etc. The nature of the crystal structure(s) present can be verified by means of X-ray diffraction XRD. The preparation of calcium phosphate of the whitlockite structure is described a.o. in U.S. Pat. No. 5,939,039. Scientific publications on whitlockite type calcium phosphate and derivatives include: Lazoryak et al., "Triple phosphates of calcium, sodium, and trivalent elements with whitlockite-like structure", *Mater. Res. Bull.* (1996), 31 (2), 207–16; L. Keller, "X-ray power diffraction patterns of calcium phosphates by the Rietveld method.", *J. Biomed. Mater. Res.*, (1995), 29(11), 1403–13; Yanov et al., "A whitlockite calcium copper phosphate", *Mater. Res. Bull.* (1994), 29(12), 1307–14.

Calcium phosphate particles of whitlockite crystal type may be used in any of the orthopaedic or dental applications known for the use of calcium phosphate, such as bone filling defect repair, oncological defect filling, dental extraction site filling, and potential drug delivery applications. See, for instance, Jarcho et al., "Synthesis and fabrication of β-tricalcium phosphate (whilockite) ceramics for potential prosthetic applications", *J. Mater. Sci.* (1979), 14(1) 142–50.

However, to our knowledge, it is the first time that the use of whitlockite type calcium phosphate as pigment in an ink jet receiver layer is disclosed. The presence of the compound gives the receiving layer a high degree of porosity so that the uptake velocity of ink droplets is strongly enhanced.

Preferably, the whitlockite type calcium phosphate is the sole pigment of the ink receiving layer. Alternatively however, it may be mixed with some other well-known pigments such as silica, talc, clay, koalin, diatomaceous earth, calcium carbonate, magnesium carbonate, aluminium hydroxide, aluminium oxide, titanium oxide; zinc oxide, barium sulfate, calcium sulfate, zinc sulfide, satin white, boehmite and pseudo-boehmite, or organic particles such as polystyrene, polymethylmethacrylate, silicones, urea-formaldehyde condensation polymers, polyesters and polyamides.

The binder can be chosen from a list of compounds well-known in the art including hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinylacetal; polyvinyl pyrrolidone; polyacrylamide; acrylamide/acrylic acid copolymer; styrene/acrylic acid copolymer; ethylene-vinylacetate copolymer; vinylmethyl ether/maleic acid copolymer; poly(2-acrylamido-2-methyl propane sulfonic acid); poly(diethylene triamine-co-adipic acid); polyvinyl pyridine; polyvinyl imidazole; polyimidazoline quaternized; polyethylene imine epichlorohydrin modified; polyethylene imine ethoxylated; poly(N,N-dimethyl-3,5-dimethylene piperidinium chloride; polyethylene oxide; polyurethane; melamine resins; gelatin; carrageenan; dextran; gum arabic; casein; pectin; albumin; starch; collagen derivatives; collodion and agar-agar.

A preferred binder for the practice of the present invention is polyvinyl alcohol (PVA).

The total dry coating weight of the receiving layer is preferably comprised between 10 and 40 g/m$^2$.

Apart from the essential ingredients described above a cationic substance acting as mordant may be present in the ink receiving layer. Such substances increase the capacity of the layer for fixing and holding the dye of the ink droplets. A particularly suited compound is a poly (diallyldimethylammonium chloride) or, in short, a poly (dadmac). These compounds are commercially available from several companies, e.g. Aldrich, Calgon, Clariant, BASF, EKA Chemicals, and Nippon Goshei. A preferred type is GOHSEFIMER K210, trade name of Nippon Goshei Co..

Other useful cationic compounds include dadmac copolymers such as copolymers with acrylamide; dimethylamine-epichlorohydrine copolymers, e.g. POLYFIX 700, trade name of Showa High Polymer Co.; other POLYFIX grades which could be used are POLYFIX 601, POLYFIX 301, POLYFIX 301A, POLYFIX 250WS, and POLYFIX 3000; NEOFIX E-117, trade name of Nicca Chemical Co., a polyoxyalkylene polyamine dicyanodiamine, and REDIFLOC 4150, trade name of EKA Chemicals, a polyamine; MADAME (methacrylatedimethylaminoethyl= dimethylaminoethyl methacrylate) or MADQUAT (methacryloxyethyltrimethylammonium chloride) modified polymers, e.g. ROHAGIT KL280, ROHAGIT 210, ROHAGIT SL144, PLEX 4739L, PLEX 3073 from Röhm, DIAFLOC KP155 and other DIAFLOC products from Diafloc Co., and BMB 1305 and other BMB products from EKA chemicals; cationic epichlorohydrin adducts such as POLYCUP 171 and POLYCUP 172, trade names from Hercules Co.; from Cytec industries: CYPRO products, e.g. CYPRO 514/515/516, SUPERFLOC 507/521/567; cationic cellulose derivatives such as CELQUAT L-200, H-100, SC-240C, SC-230M, trade names of Starch & Chemical Co., and QUATRISOFT LM200, UCARE polymers JR125, JR400, LR400, JR30M, LR30M and UCARE polymer LK; fixing agents from Chukyo Europe: PALSET JK-512, PALSET JK512L, PALSET JK-182, PALSET JK-220, WSC-173, WSC-173L, PALSET JK-320, PALSET JK-320L and PALSET JK-350; polyethyleneimine and copolymers, e.g. LUPASOL, trade name of BASF AG; triethanolamine-titanium-chelate, e.g. TYZOR, trade name of Du Pont Co.; copolymers of vinylpyrrolidone such as VIVIPRINT 111, trade name of ISP, a methacrylamido propyl dimethylamine copolymer; with dimethylaminoethylmethacrylate such as COPOLYMER 845 and COPOLYMER 937, trade names of ISP; with vinylimidazole, e.g. LUVIQUAT CARE, LUVITEC 73W, LUVITEC VPI55 K18P, LUVITEC VP155 K72W, LUVIQUAT FC905, LUVIQUAT FC550, LUVIQUAT HM522, and SOKALAN HP56, all trade names of BASF AG; polyamidoamines, e.g. RETAMINOL and NADAVIN, trade marks of Bayer AG; and phosphonium compounds such as disclosed in EP 609930.

Still other cationic compounds include gelatin when the layer pH is below the isoelectric point of the gelatin, cationic aluminum oxide, boehmite, and poly (aluminumhydroxychloride) such as SYLOJET A200, trade name of Grace Co. Still further cationic polymers include polyvinylamines, e.g. PVAM-0595B from Esprit Co., and cationic modified acrylics, e.g. ACRIT RKW319SX, trade name of Tasei Chemical Industries, and RD134 from Goo Chemical.

In an alternative embodiment the cationic substance is not incorporated in the ink receiving layer itself but in a separate thin top layer. In this case this layer is coated from an aqueous medium. Its dry coverage is preferably comprised between 0.5 and 5 g/m$^2$. The cationic mordant can also be distributed between the ink receiving bulk layer and the extra thin top layer.

Depending on the surface properties of the substrate an extra adhesive layer may be applied between the support and the ink receiving layer (undercoat layer). This layer is then coated from an aqueous medium containing any of the numerous known adhesive polymers. Preferred adhesive polymers include styrene-butadiene latex, acrylate latices, such as ethylacrylate-hydroxyethylmethacrylate, poly (ethylene-vinylacetate), polyvinylesters, copolyesters, and polyurethanes.

The dry coating weight of this undercoat layer when present is preferably comprised between 0.5 and 10 g/m$^2$.

The ink receiving layer and the optional top- and undercoat layers may further contain well-known conventional ingredients, such as surfactants serving as coating aids, hardening agents plasticizers, whitening agents and matting agents.

Surfactants may be incorporated in the ink-receiving layer of the present invention. They can be any of the cationic, anionic, amphoteric, and non-ionic ones as described in JP-A 62-280068 (1987). Examples of the surfactants are N-alkylamino acid salts, alkylether carboxylic acid salts, acylated peptides, alkylsulfonic acid salts, alkylbenzene and alkylnaphthalene sulfonic acid salts, sulfosuccinic acid salts, α-olefin sulfonic acid salts, N-acylsulfonic acid salts, sulfonated oils, alkylsulfonic acid salts, alkylether sulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed polyoxyethylene ethers, blocked polymers having polyoxypropylene, polyoxyethylene polyoxypropylalkylethers, polyoxyethyleneether of glycolesters, polyoxyethyleneether of sorbitanesters, polyoxyethyleneether of sorbitolesters, polyethyleneglycol aliphatic acid esters, glycerol esters, sorbitane esters, propyleneglycol esters, sugaresters, fluoro $C_2$–$C_{10}$ alkylcarboxylic acids, disodium N-perfluorooctanesulfonyl glutamate, sodium 3-(fluoro-$C_6$–$C_{11}$-alkyloxy)-1-$C_3$–$C_4$ alkyl sulfonates, sodium 3-(ω-fluoro-$C_6$–$C_8$-alkanoyl-N-ethylamino)-1-propane sulfonates, N-[3-(perfluorooctanesulfonamide)-propyl]-N,N-dimethyl-N-carboxymethylene ammonium betaine, fluoro-$C_{11}$–$C_{20}$ alkylcarboxylic acids, perfluoro-$C_7$–$C_{13}$-alkyl-carboxylic acids, perfluorooctane sulfonic acid diethanolamide, Li, K and Na perfluoro-$C_4$–$C_{12}$-alkyl sulfonates, N-propyl-N-(2-hydroxyethyl)perfluorooctane sulfonamide, perfluoro-$C_6$–$C_{10}$-alkylsulfonamide-propyl-sulfonyl-glycinates, bis-(N-perfluorooctylsulfonyl-N-ethanolaminoethyl) phosphonate, mono-perfluoro $C_6$–$C_{16}$ alkyl-ethyl phosphonates, and perfluoroalkylbetaine.

Useful cationic surfactants include N-alkyl dimethyl ammonium chloride, palmityl trimethyl ammonium chloride, dodecyldimethylamine, tetradecyldimethylamine, ethoxylated alkyl guanidine-amine complex, oleamine hydroxypropyl bistrimonium chloride, oleyl imidazoline, stearyl imidazoline, cocamine acetate, palmitamine, dihydroxyethylcocamine, cocotrimonium chloride, alkyl polyglycolether ammonium sulphate, ethoxylated oleamine, lauryl pyridinium chloride, N-oleyl-1,3-diaminopropane, stearamidopropyl dimethylamine lactate, coconut fatty amide, oleyl hydroxyethyl imidazoline, isostearyl ethylimidonium ethosulphate, lauramidopropyl PEG-dimoniumchloride phosphate, palmityl trimethylammonium chloride, and cetyltrimethylammonium bromide.

Especially useful are the fluorocarbon surfactants as described in e.g. U.S. Pat. No. 4,781,985, having a structure of: $F(CF_2)_{4\text{-}9}CH_2CH_2SCH_2CH_2N^+R_3X^-$ wherein R is a hydrogen or an alkyl group; and in U.S. Pat. No. 5,084,340, having a structure of: $CF_3(CF_2)_mCH_2CH_2O(CH_2CH_2O)_nR$ wherein m=2 to 10; n=1 to 18; R is hydrogen or an alkyl group of 1 to 10 carbon atoms. These surfactants are commercially available from DuPont and 3M. The concentration of the surfactant component in the ink-receiving layer is typically in the range of 0.1 to 2%, preferably in the range of 0.4 to 1.5% and is most preferably 0.75% by weight based on the total dry weight of the layer.

The ink-receiving layer according to this invention may be crosslinked to provide such desired features as waterfastness and non-blocking characteristics. The crosslinking is also useful in providing abrasion resistance and resistance to the formation of fingerprints on the element as a result of handling. There are a vast number of known crosslinking agents—also known as hardening agents—that will function to crosslink film forming materials. Hardening agents can be used individually or in combination and in free or in blocked form. A great many hardeners, useful for the present invention, are known, including formaldehyde and free dialdehydes, such as succinaldehyde and glutaraldehyde, blocked dialdehydes, active esters, sulfonate esters, active halogen compounds, isocyanate or blocked isocyanates, polyfunctional isocyanates, melamine derivatives, s-triazines and diazines, epoxides, active olefins having two or more active bonds, carbodiimides, isoxazolium salts subsituted in the 3-position, esters of 2-alkoxy-N-carboxydihydroquinoline, N-carbamoylpyridinium salts, hardeners of mixed function, such as halogen-substituted aldehyde acids (e.g. mucochloric and mucobromic acids), onium substituted acroleins and vinyl sulfones and polymeric hardeners, such as dialdehyde starches and copoly (acroleinmethacrylic acid), and oxazoline functional polymers, e.g. EPOCROS WS-500, and EPOCROS K-1000 series.

In the practice of this invention boric acid is a preferred crosslinker.

The ink-receiving layer of the present invention may also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalicanhydride, urea phosphate, triphenylphosphate, glycerolmonostearate, propylene glycol monostearate, tetramethylene sulfone, n-methyl-2-pyrrolidone, n-vinyl-2-pyrrolidone.

The ink-receiving layer of the present invention may also comprise ingredients to improve the lightfastness of the printed image, such as antioxidants, UV-absorbers, peroxide scavengers, singlet oxygen quenchers such as hindered amine light stabilizers, (Hals compounds) etc.

The ink receiving layer and the optional supplementary layers can be coated onto the support by any conventional coating technique, such as dip coating, knife coating, extrusion coating, spin coating, slide hopper coating and curtain coating.

The support for use in the present invention can be chosen from the paper type and polymeric type support well-known from photographic technology. Paper types include plain paper, cast coated paper, polyethylene coated paper and polypropylene coated paper. Polymeric supports include cellulose acetate propionate or cellulose acetate butyrate, polyesters such as polyethylene terephthalate (PET) and polyethylene naphthalate, polyamides, polycarbonates, polyimides, polyolefins, poly(vinylacetals), polyethers and polysulfonamides. Other examples of useful high-quality polymeric supports for the present invention include opaque white polyesters and extrusion blends of polyethylene terephthalate and polypropylene. Polyester film supports, and especially polyethylene terephthalate, are preferred because of their excellent properties of dimensional stability.

Typical supports for outdoor use include PET, wet strength paper, PVC, PVC with an adhesive backing, the polyethylene paper TYVEK, trade name of Du Pont Co., the porous polyethylene paper TESLIN, trade name of International Paper CO., canvas, polypropylene, and polycarbonate.

The present invention will now be illustrated by the following examples without however being limited thereto.

EXAMPLES

Example 1 (Comparative)

Preparation of the $Ca_3(PO_4)_2$ Dispersion

A $Ca_3(PO_4)_2$ powder commercially available and made by Merck was first milled by means of a sand mill (Spangenberg) using zirconium silicate pearls of 0.6 mm. The grinding took place during 6 hours leading to $Ca_3(PO_4)_2$ pigments with a particle size between 1 and 2 $\mu$m. After the milling the pearls were separated from the pigment by filtering and washing with water. The pigment content of the slurry amounted to 12% (by weight). The pigment was a heterogeneous mixture of different crystal structures, as was demonstrated by XRD.

Preparation of the Coating Solutions

A coating liquid for forming an ink recording layer was prepared by adding 5 parts by solid weight of a 10% aqueous solution of polyvinyl alcohol (POVAL 117, trade mark of K. K. Kuraray) to 94.5 parts by solid weight of the prepared $Ca_3(PO_4)_2$ dispersion. Finally, 0.5 parts by solid weight of boric acid solution was added as crossslinker.

The resultant coating liquid had a total solid content of 11.2% by weight.

Coating of the Coated Samples

The coating solution was coated on a subbed PET sheet (100 $\mu$m) using a coating knife to form an ink receiving layer having a dry weight of 28 g/m$^2$, and dried at 40° C. As is shown by the nitrogen gas adsorption method the pore volume of the layer is only 0.07 ml/g.

Color patches containing primary and secondary colors were printed on the coated samples by means of a EPSON STYLUS COLOR 460 (trademark: Seiko Epson Corp.). By means of these color patches the drying time, color density and color bleeding can be evaluated. The test results are shown in table 1.

Example 2 (Comparative)

An ink jet recording medium was produced by the same procedures as in Example 1 with the following exception. In the preparation of the coating liquid for the ink receiving layer, the polyvinyl alcohol was replaced by a cation—modified polyvinyl alcohol (GOHSEFIMER K210, trade mark of Nippon Gohsei). The test results are shown in table 1.

Example 3 (Invention)

An ink jet recording medium was produced by the same procedures as in Example 1 with the following exception. In the preparation of the dispersion for the ink receiving layer, the $Ca_3$ $(PO4)_2$ was replaced by a porous type of whitlockite crystal structure, as verified by XRD, (source Orthovita Inc.). As is shown by the nitrogen gas adsorption method the pore volume of the layer is 0.39 ml/g, much higher than for the comparative example. Further test results are shown in table 1.

Example 4 (Invention)

An ink jet recording medium was produced by the same procedures as in Example 2 with the following exception. In the preparation of the dispersion for the ink receiving layer, the $Ca_3(PO_4)_2$, was replaced by a porous type of whitlockite crystal structure, as verified by XRD, (source Orthovita Inc.). The test results are shown in table 1.

Evaluation of the Samples

TABLE 1

Test results

| Sample n° | Remark | Drying time | Bleeding |
|---|---|---|---|
| 1 | Comp. | 3' | Strong |
| 2 | Comp. | 3' | Strong |
| 3 | Inv. | <30" | no bleeding |
| 4 | Inv. | <30" | no bleeding |

As can be seen from the results, the porous $Ca_3(PO_4)_2$ leads to an important improvement of the drying time and inter color bleeding.

What is claimed is:

1. An ink jet recording element comprising a support and an ink receiving layer containing a binder and $Ca_3(PO_4)_2$ pigment characterized in that said $Ca_3(PO4)_2$ pigment consists substantially of the whitlockite crystal structure.

2. An ink jet recording element according to claim 1 wherein said binder is polyvinylalcohol.

3. An ink jet recording element according to claim 1 wherein said ink receiving layer further contains a crosslinker.

4. An ink jet recording element according to claim 3 wherein said crosslinker is boric acid.

5. An ink jet recording element according to claim 1 wherein said ink receiving layer further contains a cationic mordant.

6. An ink jet recording element according to claim 5 wherein said cationic mordant is poly (diallyldimethylammonium chloride).

* * * * *